US007776799B2

(12) United States Patent
Raison et al.

(10) Patent No.: US 7,776,799 B2
(45) Date of Patent: Aug. 17, 2010

(54) COLD ROLLING PROCESS FOR METALS USING AN AQUEOUS LUBRICANT COMPRISING AT LEAST ONE CARBOXYLIC ACID, ONE PHOSPHATE ESTER AND ONE WAX

(75) Inventors: Dominique Raison, Levallois-Perret (FR); Jean-Guy Le Helloco, Levallois-Perret (FR)

(73) Assignee: Rhodia Chimie, Cedex (FR)

( * ) Notice: Subject to any disclaimer, the term of this patent is extended or adjusted under 35 U.S.C. 154(b) by 308 days.

(21) Appl. No.: 11/866,850

(22) Filed: Oct. 3, 2007

(65) Prior Publication Data

US 2008/0028812 A1 Feb. 7, 2008

Related U.S. Application Data

(63) Continuation of application No. 10/467,151, filed as application No. PCT/FR02/00436 on Feb. 5, 2002, now abandoned.

(30) Foreign Application Priority Data

Feb. 5, 2001 (FR) ..... 01 01566

(51) Int. Cl.
*C10M 173/02* (2006.01)
*C10M 125/04* (2006.01)

(52) U.S. Cl. ..... 508/150; 508/151; 508/433; 508/436; 508/440; 508/450; 508/451; 508/459; 508/506; 508/527; 508/539; 516/56; 516/75; 516/97; 72/42

(58) Field of Classification Search ..... 508/459, 508/506, 539, 433, 440, 436, 437, 450, 451; 72/42

See application file for complete search history.

(56) References Cited

U.S. PATENT DOCUMENTS

| | | | | |
|---|---|---|---|---|
| 3,928,401 | A | 12/1975 | Sturwold et al. | |
| 3,966,619 | A | 6/1976 | Smith et al. | |
| 4,462,920 | A | 7/1984 | Snyder et al. | |
| 4,481,038 | A | 11/1984 | Girard et al. | |
| 4,612,127 | A | 9/1986 | Uematsu et al. | |
| 4,800,034 | A * | 1/1989 | Akao et al. | 508/262 |
| 5,076,339 | A | 12/1991 | Smith | |
| 5,211,861 | A * | 5/1993 | Lafratta et al. | 508/509 |
| 6,706,670 | B2 * | 3/2004 | Kalota et al. | 508/185 |
| 6,806,238 | B1 | 10/2004 | Lorentz et al. | |
| 6,843,087 | B2 * | 1/2005 | Prince et al. | 72/42 |

FOREIGN PATENT DOCUMENTS

| | | |
|---|---|---|
| FR | 1 037 447 | 9/1953 |
| FR | 2 130 981 | 11/1972 |
| FR | 2 758 561 | 7/1998 |
| FR | 2 800 091 | 4/2001 |

* cited by examiner

*Primary Examiner*—Ellen M McAvoy
*Assistant Examiner*—Chantel Graham
(74) *Attorney, Agent, or Firm*—Hunton & Williams LLP

(57) ABSTRACT

The invention concerns a method for cold rolling metals using an aqueous lubricant comprising: (1) at least a mixture based on at least an acid selected among saturated or unsaturated mono- or poly-carboxylic acids, comprising 5 to 40 carbon atoms; at least an acid phosphate ester of formula (RO)x-P(=O)(OH)x', wherein: R is a hydrocarbon radical, optionally polyalkoxylated; x and x' being equal to 3; the carboxylic acid and/or the acid phosphate ester being optionally neutralized by an organic or mineral base; and (2) at least a natural or synthetic wax exhibiting a melting point not less than 50° C. and having an average particle size ranging between 0.5 and 10 μm. The use of said lubricant enables to increase the productivity of the method by at least 15% relative to a method using a conventional lubricant.

17 Claims, No Drawings

COLD ROLLING PROCESS FOR METALS USING AN AQUEOUS LUBRICANT COMPRISING AT LEAST ONE CARBOXYLIC ACID, ONE PHOSPHATE ESTER AND ONE WAX

CROSS REFERENCE TO RELATED APPLICATIONS

This application is a continuation of U.S. application Ser. No. 10/467,151, filed Nov. 17, 2003, which is the National Stage application of International Patent Application No. PCT/FR02/00436, filed Feb. 5, 2002, which claims the benefit of priority to French Patent Application No. 01566 filed Feb. 5, 2001, the disclosures of each of which are herein incorporated by reference in their entireties.

The subject of the present invention is a cold rolling process for metals using an aqueous lubricant comprising a mixture based on at least one carboxylic acid, on at least one phosphate ester and including at least one wax.

During metal deformation operations, especially such as cold rolling, it is necessary to use lubricants. This is because such operations take place at very high speeds, pressures and applied forces, the direct consequence of which is to create an extremely high friction coefficient. Such friction coefficient values limit the productivity of the machines, since their maximum capacity is rapidly reached.

There are various types of lubricants, such as for example whole oils and aqueous lubricants.

In the particular case of cold rolling operations, the use of whole oils is the most common on an industrial scale, although the use of aqueous lubricants is mentioned in the literature. However, the use of these whole oils is limited and they do not allow the productivity of the process to be significantly increased. To reduce the thickness of a sheet, for example, it is necessary to carry out several passes through the rolling mill. However, to increase productivity it would be necessary to be able to limit the number of passes through the rolling mill, which implies increasing the thickness reduction ratio of the sheet for each pass. To achieve such a result, the mechanical stresses would have to be increased. But this would result in a degradation of the surface finish of the rolled sheet (scratches) and/or in the maximum reduction capacity of the tool being exceeded.

The use of what are called "extreme pressure" additives delays the appearance of these phenomena. Thus, the extreme-pressure properties of the lubricant allow the deformation of the metal (thickness reduction) to be increased while remaining below the limiting reduction force of the machine, by limiting microwelds between the surface asperities on the metal and on the tool.

Various types of extreme-pressure additives exist, the fields of application of which are different depending, among other things, on the temperatures at the points of contact between the tool and the metal to be converted. The reason for this is that these additives above a certain temperature release a compound that reacts with the metal surface to create a species that will protect the system. On the other hand, the field of use of the additive in question will be limited by the temperature at which the species created will degrade. Thus, when chlorinated compounds are used as extreme-pressure additive, a metal chloride layer is created on the surface of the metal by reaction of the chlorine released with said surface at an appropriate temperature. The other additives used are based on sulfur (sulfur-containing esters, sulfur-containing oils) or based on phosphorus (phosphate esters) or mixtures thereof. They result in the formation of a metal sulfide or a metal phosphate.

However, the use of such additives does not always provide a satisfactory solution for increasing the productivity.

As regards the use of an aqueous lubricant in cold rolling, this has no particular advantage, except that it does mean that the metal and the tool are cooled more effectively. However, it is possible to increase the thickness reduction ratio per pass of the sheet by adding conventional extreme-pressure additives. Unfortunately, these aqueous lubricants are very far from providing a satisfactory solution for achieving the desired productivity increase. In addition, the occurrence of a phenomenon unacceptable in the field, namely an irreversible degradation of the metal surface (coloration, roughness), may be observed.

Thus, as may be stated in the case of the cold rolling of metals, there are still no lubricants that make it possible to reduce the number of passes through the rolling mill and allow the productivity of this process to be increased without substantial degradation of the surface finish of the rolled product being observed.

The object of the present invention is to propose a cold rolling process for metals that does not have the drawbacks of the usual processes. Thus, the process according to the invention makes it possible to work under very severe conditions, representative of high-productivity conditions, while still maintaining the surface finish (coloration, brightness) of the deformed metal.

These and other objectives are achieved by the present invention, the subject of which is thus a cold rolling process for metals using an aqueous lubricant comprising (1) at least one mixture based on at least one acid chosen from saturated or unsaturated, monocarboxylic or polycarboxylic acids containing 5 to 40 carbon atoms; on at least one acid phosphate ester of formula $(RO)_x—P(=O)(OH)_{x'}$, in which formula R is an optionally polyalkoxylated hydrocarbon radical, x and x' being equal to 1 or 2, provided that the sum of x and x' is equal to 3; the carboxylic acid and/or the acid phosphate ester being optionally neutralized by an organic or mineral base; and (2) at least one natural or synthetic wax having a melting point not less than 50° C. and having a mean particle size ranging between 0.5-10 μm.

Unless otherwise indicated, the size measurements are carried out either by laser diffraction or by light scattering. There is no difficulty for those skilled in the art to choose one of these two methods depending on the size of the objects.

The expression "conventional lubricant" is understood to mean either a whole oil containing one or more extreme-pressure additives, or an aqueous lubricant also containing one or more extreme-pressure additives. It should be noted that conventional extreme-pressure additives are compounds containing phosphorus (such as for example phosphates) or sulfur (such as especially sulfonates).

Completely surprisingly, the use of an aqueous lubricant according to the invention allows the productivity of cold rolling operations to be significantly improved. Thus, by using this lubricant it is possible to increase the thickness reduction ratio of the rolled metal by at least 15%, more particularly by at least 20% and highly advantageously by at least 30%, compared with the maximum reduction ratio achievable by a rolling mill using a conventional lubricant, whether a whole oil containing one or more extreme-pressure additives or an aqueous lubricant containing one or more extreme-pressure additives.

Moreover, such results are achieved while maintaining a surface finish of the rolled metal that meets the requirements of those skilled in the art, especially as regards its coloration and its brightness.

Finally, the lubricants employed within the context of the present invention, after thermal degradation once the rolling operation has been carried out, leave no solid residues on the metal.

However, other advantages and features will become more clearly apparent on reading the description and from the examples that follow.

Thus, as was indicated previously, the aqueous lubricant comprises at least one mixture based on at least one acid chosen from saturated or unsaturated, monocarboxylic or polycarboxylic acids containing 5 to 40 carbon atoms; on at least one acid phosphate ester of formula $(RO)_x—P(=O)(OH)_{x'}$, in which formula R is an optionally polyalkoxylated hydrocarbon radical, x and x' being equal to 1 or 2, provided that the sum of x and x' is equal to 3, the carboxylic acid and/or the acid phosphate-ester being optionally neutralized by an organic or mineral base.

It should be noted that the mixture (1) may be an aqueous solution or an aqueous dispersion. The term "dispersion" denotes a dispersion of vesicles, droplets or micelles in an aqueous medium.

Firstly, the carboxylic acid used possesses one or more carboxylic functional groups and at least one radical containing 5 to 40 carbon atoms, said radical being a linear or branched, alkyl or alkenyl radical having one or more ethylenically unsaturated groups (carbon-carbon double bonds) and optionally being substituted with one or more hydroxyl radicals.

According to one advantageous method of implementing the invention, the acid possesses one or more carboxylic functional groups and a radical containing 7 to 30 carbon atoms, optionally substituted with one or more hydroxyl radicals and optionally having one or more ethylenically unsaturated groups.

Preferably, said acid possesses one carboxylic functional group or two. When this second functional group is present, it may or may not be at the end of the chain.

Preferably, the carboxylic acid is a saturated or unsaturated fatty acid, more particularly comprising a single carboxylic functional group, or a mixture of several fatty acids.

As examples of saturated fatty acids, mention may be made of caproic, caprylic, capric, lauric, myristic, stearic, isostearic, palmitic, behenic and lignoceric acids.

As examples of unsaturated fatty acids, mention may be made of the unsaturated fatty acids having a single ethylenically unsaturated group, such as linderic, myristoleic, palmitoleic, oleic and erucic acids; unsaturated fatty acids having two ethylenically unsaturated groups, such as linoleic acid; unsaturated fatty acids having three ethylenically unsaturated groups, such as linolenic acid; and unsaturated fatty acids carrying a hydroxyl group, such as ricinoleic acid, as well as mixtures thereof.

It is preferred to use palmitic, behenic, stearic, isostearic, palmitoleic, oleic, erucic, linoleic, linolenic or ricinoleic acids, or mixtures thereof.

As regards the acid phosphate esters, these correspond to the following formula $(RO)_x—P(=O)(OH)_{x'}$, in which formula the radicals R, which may or may not be identical, represent an optionally polyalkoxylated hydrocarbon radical, x and x' being equal to 1 or 2, provided that the sum of x and x' is equal to 3.

Preferably, the acid phosphate ester corresponds to the following formula:

$[R(OA)_y]_x$-$P(=O)(OH)_{x'}$, in which formula the radicals R, which may or may not be identical, represent a hydrocarbon radical containing 1 to 30 carbon atoms, the radicals A, which may or may not be identical, represent a linear or branched alkylene radical containing 2 to 4 carbon atoms, y, which is an average value, is between 0 and 100 and x and x' are equal to 1 or 2, provided that x+x'=3.

More particularly, R is a hydrocarbon radical containing 1 to 30 carbon atoms, said radical being a saturated or unsaturated, aliphatic or cycloaliphatic radical or an aromatic radical. Preferably, the radicals R, which are identical or different, are linear or branched radicals containing 8 to 26 carbon atoms, these being alkyl radicals or alkenyl radicals carrying one or more ethylenically unsaturated groups. As examples of such radicals, mention may especially be made of stearyl, oleyl, linoleyl and linolenyl radicals. Furthermore, the radicals R, which may or may not be identical, may be aromatic radicals carrying alkyl, arylalkyl or alkylaryl substituents, these radicals containing 6 to 30 carbon atoms. As examples of such radicals, mention may be made, among others, of nonylphenyl, monostyrylphenyl, distyrylphenyl and tristyrylphenyl radicals.

More particularly, the OA groups, which may or may not be identical, correspond to an oxyethylene, oxypropylene or oxybutylene radical, or mixtures thereof. Preferably, said group corresponds to an oxyethylene and/or oxypropylene radical.

As regards the average value of y, this is preferably between 0 and 80.

The acid phosphate ester forming part of the composition of the mixture (1) may be formed from a combination of several of them.

Furthermore, the carboxylic acid and/or the acid phosphate ester may be in a form neutralized by a mineral or organic base.

It should be noted that the bases used are preferably water-soluble. The term "water-soluble bases" is understood to mean compounds soluble in an aqueous medium, at 20° C., with a concentration of from 3 to 7% by weight.

Thus, as nonlimiting examples of such compounds, mention may be made of alkali-metal and ammonium hydroxides, hydroxycarbonates, carbonates and bicarbonates.

Preferably, the bases employed are organic bases but are more particularly chosen from primary, secondary or tertiary amines or polyamines comprising at least one linear, branched or cyclic hydrocarbon radical having 1 to 40 carbon atoms, said radical being optionally substituted with one or more hydroxyl radicals and/or one or more alkoxylated groups. The said alkoxylated groups are preferably ethoxylated units. In addition, the number of alkoxylated units, if present, is less than or equal to 100.

According to a preferred method of implementation of the invention, when the amines have at least two amine functional groups, said functional groups are separated in pairs by a number of carbon atoms ranging between 2 and 5.

As suitable amines, mention may be made of monoethanolamine, diethanolamine, ethylenediamine, aminoethylethanolamine and aminomethylpropanolamine. Polyalkoxylated fatty amines may also be used as organic base, such as for example those sold by Rhodia Chimie under the name Rhodameen® CS20.

Advantageously, at least the carboxylic acid is neutralized by an organic base, the amount of the latter being such that the total number of moles of amine functional groups is at least equal to the total number of moles of carboxylic acid functional groups, and preferably at least twice as large.

The mixture (1) may optionally furthermore include at least one nonionic surfactant. The use of this type of compound may be desired when the mixture (1) is in the form of a dispersion.

Among suitable surfactants of this type, mention may be made inter alia of:

- polyalkoxylated alkylphenols, in particular those in which the alkyl substituent is a $C_6$-$C_{12}$ one;
- polyalkoxylated mono-, di- or tri-(alkylaryl)phenol, preferably chosen from those in which the alkyl substituent is a $C_1$-$C_6$ one;
- polyalkoxylated-aliphatics, more particularly $C_8$-$C_{22}$ alcohols;
- polyalkoxylated triglycerides;
- polyalkoxylated fatty acids;
- polyalkoxylated sorbitan esters; and
- optionally polyalkoxylated, preferably $C_8$-$C_{20}$, fatty acid amides.

The number of polyalkoxylated units, if present, of these nonionic surfactants usually varies from 2 to 100. It should be noted that the term "polyalkoxylated units" is understood to mean ethoxylated units, propoxylated units or mixtures thereof.

The amount of surfactant usually varies, if it is present, between 1 and 30% by total weight of the mixture (1).

In the mixture (1), the contents of carboxylic acid, of acid phosphate ester, optionally of base, preferably an organic base, and optionally of nonionic surfactant are such that the solids content of the aqueous medium is at least 10% by weight. More precisely, the solids content is between 10 and 70% by weight. Preferably, the solids content varies between 10 and 40% by weight.

Advantageously, the pH of the mixture (1) ranges between 7 and 9. This pH range may inter alia be achieved by the addition of a buffer agent to said mixture.

According to a variant of the invention, said mixture (1) is combined with at least one metal in the form of a multivalent ion. More particularly, said metal may be in the form of a divalent ion or a trivalent ion. Likewise, it would not be excluded to use several metals, in identical or different oxidation states.

According to one particular method of implementing the invention, said metal is chosen from columns IIA, VIII, IB, IIB and VIB, with the exception of cobalt and nickel.

More particularly, the metals are chosen from calcium, magnesium, copper, zinc, iron, aluminum and chromium, by themselves or as mixtures.

In the case of this variant, the mixture (1) associated with the metal is more precisely in the form of a dispersion comprising lamellar crystallites having a length ranging between 0.1 and 100 μm, a width ranging between 0.5 and 30 μm and a thickness ranging between 5 and 200 nm.

These crystallites comprise a stack of organic phases (O) and of aqueous solutions (A) in the sequence O/[A/O]n, n being an integer different from 0 and such that a stack has a thickness of 5 to 200 nm. More particularly, n is between 1 and 20.

As regards the size of the crystallites, their length is advantageously between 0.5 and 20 μm. The width of the lamellar crystallites is more particularly between 0.5 and 10 μm. Finally, the thickness of the lamellar crystallites is preferably between 10 and 100 nm. The abovementioned dimensions of the lamellar crystallites correspond to average values. In other words, there is a distribution in the sizes of the lamellar crystallites, the average of which lies within the above ranges. The measurements of the dimensions of the lamellar crystallites are carried out using transmission electron microscopy on a specimen vitrified cryogenically (Cryo-Met—see O. Aguerre-Chariol, M. Deruelle, T. Boukhnikachvili, M. In and N. Shahidzadeh, "Cryo-Met sur échantillons vitrifiés: principes, applications aux émulsions et dispersions de tensioactifs" ["*Cryo-Met on vitrified specimens: principles and applications to surfactant emulsions and dispersions*", Proceedings of the Congrés Mondial-de l'Emulsion [*World Emulsion Congress*], Bordeaux, France (1997)).

Within the context of this variant, the crystallites are advantageously used in the presence of at least one nonionic surfactant.

The crystallites may be obtained by bringing a solution or dispersion containing the acid phosphate ester and the optionally neutralized carboxylic acid into contact with the metal in ionic and/or metallic form.

As regards the metal, this may equally well be in its metallic form or in the form of a multivalent cation. Said cation may itself be in the form of a solid, a solution or a dispersion.

When the metal is used in the form of a solution, preferably an aqueous solution, it is possible to use, for example, salts of mineral acids, such as halides, with chlorides for example, or nitrates; and likewise salts or organic acids, such as, among others, formates and acetates.

It is also conceivable to use the metal in an oxide, hydroxide or carbonate form, or the metal itself.

Preferably, the contacting is carried out in the presence of at least one compound having the effect of buffering the pH. More particularly, one or more compounds are chosen such that the pH of the medium is between 7 and 9.

The contacting takes place with stirring. Preferably, the metal in the chosen form is introduced into the mixture (1), the carboxylic acid preferably being neutralized by an organic base.

The operation advantageously takes place at a temperature below 100° C. and preferably at a temperature ranging between 20 and 60° C.

The aqueous lubricant used in the cold rolling process according to the invention furthermore includes at least one natural or synthetic wax, having a melting point not less than 50° C. and having a mean particle size ranging between 0.5-10 μm.

The wax or waxes are dispersed within the mixture (1) in a homogeneous and stable manner.

More particularly, these waxes are chosen from natural waxes of the type consisting of paraffin waxes or synthetic waxes having ester and/or amide functional groups.

Preferably, the waxes used are those having amide functional groups. Said waxes may be obtained, for example, by a condensation reaction, and more particularly by a reaction of an ester or acid functional group with an amine functional group. Preferably, these waxes have a degree of polymerization of at most 10 and advantageously at most 3.

According to a preferred method of implementing the invention, the aforementioned waxes correspond to the following formula: R'—CO-A-$(CR''_2)_{n''}$A—CO—R', in which formula the radicals R', which may or may not be identical, represent an aliphatic radical containing 5 to 22 carbon atoms, said radical being saturated or having one or more conjugated or nonconjugated carbon-carbon double bonds; the radicals R", which may or may not be identical, represent a hydrogen atom or an alkyl radical containing 1 to 4 carbon atoms; n represents an integer between 2 and 12; and the radicals A, which may or may not be identical, represent —O— or —NH—. It should be noted that the radicals A are preferably of the same type.

As examples of such waxes, mention may most particularly be made of bis(amide) waxes, such as an ethylene bis(alkylamide) or an ethylene bis(alkenylamide).

Preferably, the melting point of the waxes is not less than 80° C.

The wax content in the aqueous lubricant during its use is between 0.05 and 10% by weight of the lubricant, preferably between 0.05 and 5% by weight of the lubricant.

The wax may be introduced into the mixture either by incorporating the wax particles, the size of which lies within the abovementioned range, into said mixture. It is also possible to introduce the wax by adding the latter in molten form to the mixture, and to precipitate it in the mixture, the operation advantageously taking place by carrying out a grinding operation so as to obtain the appropriate size of particles.

The aqueous lubricants according to the invention may also include additives that are conventional in this field, such as preservatives, anticorrosion agents, antifoams and stabilizers.

It would not be outside the scope of the present invention to add conventional lubrication additives to the aqueous lubricant used in the invention. As nonlimiting examples of such additives, mention may be made of mineral or vegetable oils, fatty alcohols, fatty acids and their ester or amide derivatives. The content of these compounds, if present, in the aqueous lubricant during its use does not usually exceed 10% by weight of the aqueous lubricant during its use.

The lubricants that have just been described are particularly appropriate for lubrication in the cold rolling of metals.

The metals on which such treatments may be carried out are especially, and mainly, steels, stainless steels, aluminum, copper, zinc, tin, copper-based alloys (bronze, brass), etc.

The present invention is most particularly applicable to the cold rolling of stainless steel.

A specific but nonlimiting example of the invention will now be presented.

EXAMPLE

Composition According to the Invention

The following mixture was prepared in water, and with stirring:

| | |
|---|---|
| oleic acid: | 9% by weight |
| wax (*): | 10% by weight |
| RHODAFAC PA35 (**): | 5% by weight |
| $H_3PO_4$/diethanolamine: | sufficient amount to have a pH of between 7 and 9 (buffer). |

(*) ethylene bis(stearamide): size between 0.5 and 10 μm;

(**) polyethoxylated phosphate ester (derived from a mixture of fatty alcohols having an average carbon number of about 17 and about five ethoxylated units; sold by Rhodia Chimie).

The resulting mixture was then diluted 10 times.

Tests:

The tests took place on a rolling mill comprising two 10 cm diameter rolls.

The rolled metal was coiled stainless steel, 10 mm in width and about 0.4 mm in thickness.

The applied force on the rolls varied from 200 metric tones/m to 1200 metric tones/m, so as to obtain a sheet reduction ratio varying from 20 to 55%.

During the tests, the lubricant was used at 80° C.

Results:

The lubricant according to the invention made it possible to obtain, for a linear speed of the rolls of 5 m/s, reduction ratios of at least 55% without having reached the clamping limit of the rolling mill.

The same tests carried out with a lubricant of the whole oil type, containing an extreme-pressure additive (of the phosphate ester type), showed that, for a linear speed of 5 m/s, a maximum reduction ratio of 30% was obtained before clamping of the rolling mill.

The use of an aqueous lubricant containing a phosphate ester as extreme-pressure additive showed that the maximum reduction ratio achieved before clamping of the rolling mill was 45%.

It should be noted that increasing the linear speed (12 m/s speed) confirmed the superiority of the performance of the lubricants according to the invention compared with whole oils and with aqueous lubricants.

The invention claimed is:

1. A cold rolling process for metals using an aqueous lubricant comprising (1) at least one mixture based on:

a) at least one acid chosen from saturated or unsaturated, monocarboxylic or polycarboxylic fatty acids containing 5 to 40 carbon atoms; and b) at least one acid phosphate ester of formula $(RO)_x$-P(=O)$(OH)_{x'}$, wherein R is a hydrocarbon radical optionally polyalkoxylated, x and x' being equal to 1 or 2, provided that the sum of x and x' is equal to 3; and (2) at least one natural or synthetic wax having a melting point not less than 50° C. and having a mean particle size ranging between 0.5-10 μm;

wherein the mixture (1) further comprises at least one metal in the form of a multivalent ion: forming an assembly being in the form of lamellar crystallites of length ranging between 0.1 and 100 μm, of width ranging between 0.5 and 30 μm and of thickness ranging between 5 and 200 nm, and comprising a stack of organic phases (O) and of aqueous solutions (A) in the sequence O/[A/O]n, n being an integer different from 0 and such that the stack has a thickness of 5 to 200 nm, said organic phases comprising the mixture (1) and said metal.

2. The process as claimed in claim 1, wherein the carboxylic acid or the acid phosphate ester is further neutralized by an organic or mineral base.

3. The process as claimed in claim 1, wherein the carboxylic acid of the mixture (1) comprises one or more carboxylic functional groups and at least one linear or branched, alkyl radical or alkenyl radical having one or more ethylenically unsaturated groups, said radicals optionally being substituted with one or more hydroxyl radicals.

4. The process as claimed in claim 1, wherein the acid phosphate ester of the mixture (1) corresponds to the following formula:

$$[R(OA)_y]_x\text{-}P(=O)(OH)_{x'}$$

wherein the radicals R, which are identical or different, represent a hydrocarbon radical containing 1 to 30 carbon atoms, the radicals A, which are identical or different, represent a linear or branched alkylene radical containing 2 to 4 carbon atoms, y, which is an average value, is between 0 and 100 and x and x' are equal to 1 or 2, provided that x+x'=3.

5. The process as claimed in claim 2, wherein the mineral base is an alkali-metal hydroxide, ammonium hydroxide, hydroxycarbonate, carbonate or bicarbonate.

6. The process as claimed in claim 2, wherein the organic base is a primary, secondary or tertiary amine or polyamine, comprising at least one linear, branched or cyclic hydrocarbon radical having 1 to 40 carbon atoms, optionally substituted with one or more hydroxyl radicals or one or more oxyalkylene groups.

7. The process as claimed in claim 1, wherein the waxes are natural waxes or synthetic waxes comprising ester or amide functional groups.

8. The process as claimed in claim 7, wherein the waxes are paraffin waxes.

9. The process as claimed in claim 7, wherein the synthetic waxes correspond to the following formula:

$$R'—CO-A-(CR''_2)_n-A-CO—R'$$

wherein the radicals R', which are identical or different, represent an aliphatic radical containing 5 to 22 carbon atoms, said radical being saturated or having one or more conjugated or nonconjugated carbon-carbon double bonds;

the radicals R", which are identical or different, represent a hydrogen atom or an alkyl radical containing 1 to 4 carbon atoms;

n represents an integer between 2 and 12; and the radicals A, which are identical or different, represent —O— or —NH—.

10. The process as claimed in claim 7, wherein the waxes have a melting point not less than 80° C.

11. The process as claimed in claim 1, wherein the length of the lamellar crystallites is between 0.5 and 20 μm, the width of the lamellar crystallites is between 0.5 and 10 μm and the thickness of the lamellar crystallites is between 10 and 100 nm.

12. The process as claimed in claim 11, wherein the metal is in the form of a multivalent cation from columns IIA, VIII, IB,IIB and VIB, with the exception of cobalt and nickel.

13. The process as claimed in claim 1, wherein the wax during its use presents a content in the aqueous lubricant of between 0.05 and 10% by weight of the lubricant.

14. The process as claimed in claim 13, wherein the total content is of between 0.05 and 5% by weight of the lubricant.

15. The process as claimed in claim 1, being applied to a cold rolling of metals.

16. The process as claimed in claim 13, wherein the metals are steels, stainless steels, copper, zinc, tin or copper-based alloys.

17. The process as claimed in claim 16, wherein being applied to the cold rolling of stainless steels.

* * * * *